United States Patent [19]

di Donato

[11] 4,285,519

[45] Aug. 25, 1981

[54] PING-PONG POKER

[76] Inventor: Jose E. di Donato, 3545 Island Rd., Wantagh, N.Y. 11793

[21] Appl. No.: 127,104

[22] Filed: Mar. 4, 1980

[51] Int. Cl.[3] ..... A63B 39/00

[52] U.S. Cl. ..... 273/30; 273/393

[58] Field of Search ..... 273/379, 393, 30, 391

[56] References Cited

U.S. PATENT DOCUMENTS

| | | | |
|---|---|---|---|
| 755,936 | 3/1904 | Ricar | 273/30 |
| 1,579,004 | 3/1926 | Kolinski | 273/393 |
| 1,680,167 | 8/1928 | Noda | 273/379 |
| 1,733,606 | 10/1929 | Junker | 273/391 |
| 3,817,528 | 6/1974 | Stuhler | 273/393 |

FOREIGN PATENT DOCUMENTS

| | | | |
|---|---|---|---|
| 784191 | 7/1935 | France | 273/30 |

*Primary Examiner*—Richard C. Pinkham
*Assistant Examiner*—T. Brown

[57] ABSTRACT

A guide-ball game for card playing where a broad flat, hard, smooth surfaced table with a separate unit, gallery type card-rack for a table divider mounted on top and center of the table—the card-rack is attached to the table top by metal clamps on each end of the card-rack that screw lock on to the sides of the table—the card rack holds a series of playing cards in a specific number of horizontal rows and vertical ties. The playing cards all have magnetized metallic edges—set in the card-rack—each held upright in separate compartments by magnetized metallic stripping, so that upon impact by the guide-ball in play, the upright card will break away from magnetic contact and free fall to the table surface. End shields are provided at the card rack extremes to help keep the ball in play.

3 Claims, 5 Drawing Figures

PING-PONG POKER

SUMMARY OF THE INVENTION

The volley action of guide-ball poker will be somewhat comparable to a form of table top paddle tennis which is familiar to players throughout much of the world. It is readily played indoors and outdoors by people of all strata in many age groups and much enjoyed by both male and female players. It is also a game of manual skill which requires qualified technique in dexterity and agility to achieve proficiency.

Games of chance which make use of playing cards, to a degree are also considered games of memory technique and memory skill and are widely played by people of all strata, age groups and includes both sexes.

It is the object of the present invention to merge into a new combination both a guided action ball game and a playing card game with a single entity so that both designated ingredients can be played within a single unit or a single game.

Another object of the invention is to provide the opportunity of engaging in a card playing game using the facility and manual skill of a ball in hand paddle action to achieve an end result rather than only the sheer chance of luck for the draw of the playing cards.

A still further object of the invention is to assure continuous play of guide-ball hand paddling during a game of card playing until a final end result is achieved.

Further objects and advantages will become apparent from a reading of the specifications and a study of the accompanying.

BRIEF DESCRIPTION OF THE DRAWINGS

Now describing the invention in more detail, it being understood that like parts will be given the same reference throughout the various figures.

Figure 1:
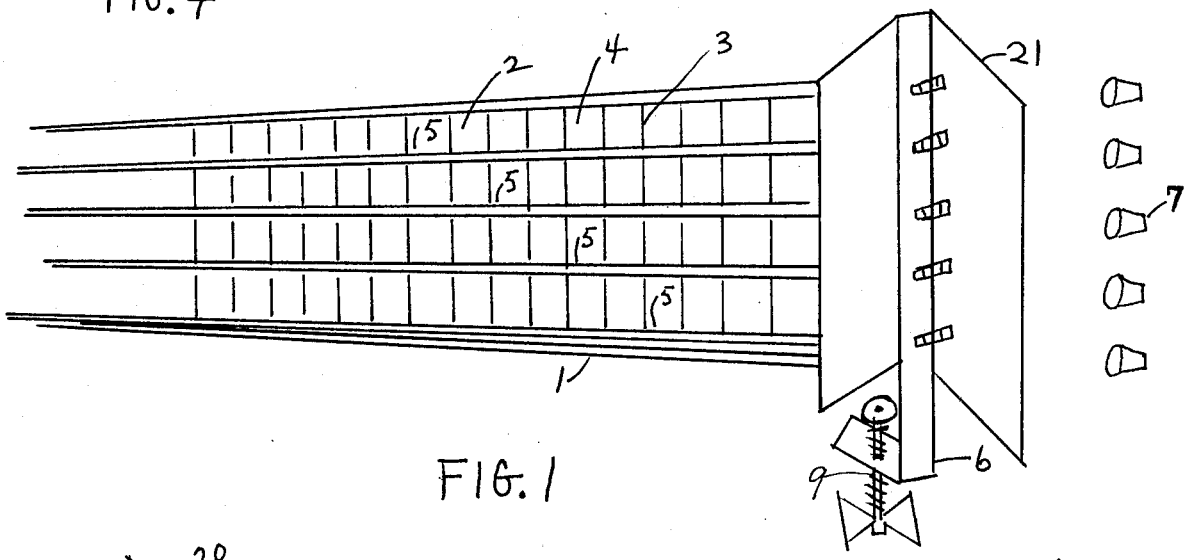
FIG. 1 shows a separate unit table top divider, gallery type card-rack partially sectioned including an array of playing cards according to the invention.

There is shown in FIG. 1 a separate unit table top divider, gallery type card-rack 1 partially sectioned and comprising an array of singular playing cards 2 stacked in four separate rows or tiers 3, each tier composed of a plurality of single different playing cards 4 held between a pair of spaced parallel support rods 5 which are each in turn end supported by vertical brace bars 6 at opposite sides of the table (not shown) and clamped to the top sides of the table by suitable metal screw drive clamps 9. The individual playing cards although each being different, is the same on both its opposing surfaces so that the same picture playing card is viewed from both sides of the playing table. The support rods 5 are each held fast to the brace 6 by snap-lock caps 7 each disposed to snap on in locking fashion to the end portions of the support rods.

Figure 4:
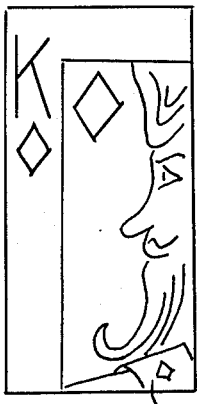
FIG. 4 shows a section of a single playing card and the magnetized metallic edged border configuration.
Figure 3:
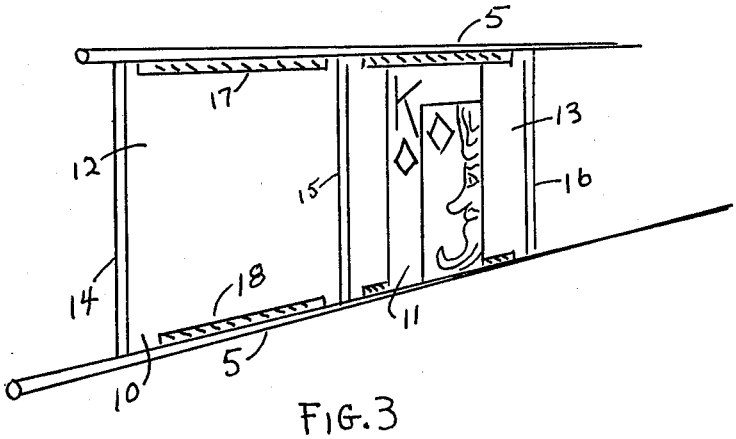
FIG. 3 shows typically a section of the card array and the supportive features thereof, including magnetized metallic stripping.
Figure 5:
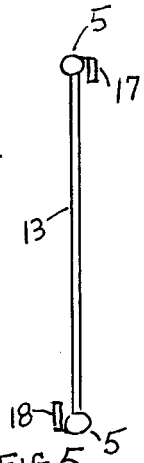
FIG. 5 is an end view of a single playing card and the supports therefor, including magnetized metallic stripping.

FIG. 3 shows partially a pair of stacked playing cards which have magnetized metallic edges 10, 11 each vertically disposed between support rods 5 and compartmentalized in sections 12, 13 defined by vertical partition poles 14, 15 and 16, and each held uprightly secured by intermittent magnetized metallic strippings 17, 18 carried by the support rods in each of the separate compartments along the entire support rods.

Further, the magnetized metallic strippings are each selectively placed in proper position relative to the individual magnetized edged playing cards so that one magnetized metallic strip appears at one extremity of the playing card above one surface and the other magnetized metallic strip appears at the opposite extremity along the other surface of the same playing card. This arrangement for positioning of the magnetized metallic stripping relative to the card permits the one individual card to fall free in the same general direction as the moving ball in play impacting into the vertically positioned card as will be described later.

Figure 2:
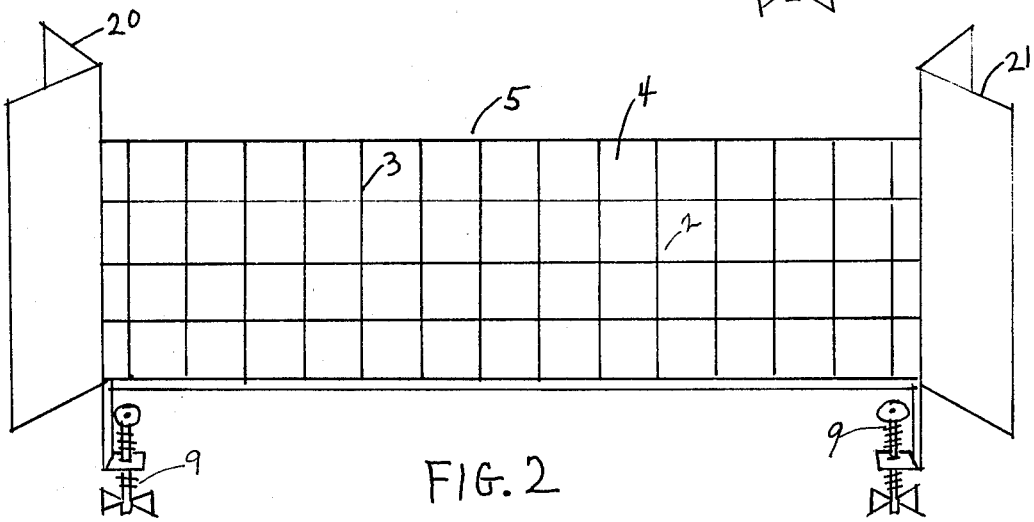
FIG. 2 shows in elevation the complete gallery type card-rack and card array including extreme and deflecting shields according to the invention.

There is disposed at the opposing ends of the gallery type card-rack as shown in FIGS. 1 and 2, end angular deflection shields 20, 21 attached to brace bars 6 and each disposed to deflect the designated ball during play action when so impacted thereby, so as to maintain or keep the same ball in continuous action play.

In operation the game is usually played by two individuals in the user manner with each facing one another from opposite ends of the table, and whenever a card vertically positioned in the card-rack is impacted by the ball in play, the impacting force of the ball is sufficient to dislodge the magnetized metallic edged playing card from the magnetic contact of the magnetized metallic stripping, so that the one particular card falls free to the table surface.

The impacting force of the ball in play although sufficient to overcome the restraining magnetic forces continues to have sufficient momentum and inertia to keep in play to the other side of the table so that the opposite player will have an opportunity to return the ball by manual hand paddle action.

This volley action play continues until a set number of playing cards are dislodged from the card-rack by impact from the ball in play and fall free onto the deck of the table and the game thereafter ceases, so that an evaluation of the playing cards and the outcome of the game can be decided.

The playing cards are generally made from very light weight mateials with magnetized metallic edges, having practically no weight or inertia, but stiff enough to function properly in the game.

The separating compartment poles and the supporting rods are very fine gauge materials so that the ratio of space to material is considerably large and that the probability of direct impact by the ball in play is quite small.

The actual game of cards contemplated is optional although such games as poker, rummy, black jack and the like is something for consideration. There are any number of variations possible with the invention and the number of playing cards used is a matter of choice of game, but the general essence of the invention is the use of manual skill engaging a designated ball in volley action with hand held disk shaped paddles as an instrument to play a game of cards or use it as a game of chance.

It is possible to play other games such as bingo, even-odd play and etc.

Having described the invention what is claimed is:

1. A guide-ball card game comprising: the combination of a smooth, hard surface platform table and a gallery card rack extending across a central part of said table; said rock comprising a plurality of horizontally and vertically spaced card support members; a vertically extending support post attached at each end of said card support members for holding said members in said spaced relationship; each of said support posts having clamping means for attaching said rack to said table; an arry of playing cards positioned within said space between each of said card support members; each of said cards having a first attachment means on at least two opposite edges thereof; said card support members having second attachment means thereon whereby said cards are releasably attached thereto and held vertically between said card support members, said cards being releasable from said rack when impacted on either side thereof by a ball during game play; means on said rack for compartmentalizing each of said spaces between said support members, each compartment being of a size to have a said card therein; means defining a shield at each end of said rack, said shield being positioned such that a ball impinged thereagainst will be deflected back to a player.

2. A guide-ball card game according to claim 1 wherein said first and second attachment means comprise magnetized metallic materials.

3. A guide-ball card game according to claim 1 and wherein said end shield means comprises an angular structural member disposed to have the displacement angle thereof sufficient to deflect the designated ball to maintain continued play.

* * * * *